United States Patent [19]

McKenna

[11] Patent Number: 4,690,086

[45] Date of Patent: Sep. 1, 1987

[54] WATER SAILING CRAFT

[76] Inventor: Quentin M. McKenna, P.O. Box 512, Waimanalo, Hi. 96795

[21] Appl. No.: 695,696

[22] Filed: Jan. 28, 1985

[51] Int. Cl.[4] ..... B63B 1/14

[52] U.S. Cl. ..... 114/39; 114/61; 114/98; 114/123; 403/119; 403/152

[58] Field of Search ..... 114/39.1, 61, 123, 102, 114/103, 104, 105, 218, 90, 91, 92, 93, 98; 212/190, 192; 403/152, 161, 163, 119

[56] References Cited

U.S. PATENT DOCUMENTS

| | | | |
|---|---|---|---|
| 19,067 | 1/1958 | Boyd . | |
| 19,996 | 4/1958 | Joline . | |
| 373,671 | 11/1887 | Martin | 114/105 |
| 526,263 | 9/1894 | Rosenfeld | 212/190 |
| 569,601 | 10/1896 | De Bem | 114/105 |
| 633,904 | 9/1899 | Pool | 114/123 |
| 831,636 | 9/1906 | Suhm . | |
| 1,642,716 | 9/1927 | Bentzen . | |
| 1,656,412 | 1/1928 | Barnhart . | |
| 2,106,209 | 1/1938 | Edge | 114/39 |
| 3,173,395 | 3/1965 | Laurent | 114/39 |
| 3,212,109 | 10/1965 | Roman | 9/2 |
| 3,265,026 | 8/1966 | Hamilton | 114/61 |
| 3,395,664 | 8/1968 | Greenberg et al. | 114/39 |
| 3,631,828 | 1/1972 | Smith | 114/39 |
| 3,646,902 | 3/1972 | Smith | 114/66 |
| 3,691,976 | 9/1972 | Wilson | 114/39 |
| 3,827,206 | 8/1974 | Nierle | 52/648 |
| 3,831,539 | 8/1974 | Black | 114/39 |
| 3,870,004 | 3/1975 | Bailey | 114/39 |
| 3,902,443 | 9/1975 | McDougall | 114/39 |
| 3,930,562 | 1/1976 | Zorn | 182/92 |
| 3,981,258 | 9/1976 | Smith | 114/283 |
| 3,991,694 | 11/1976 | Black | 114/39 |
| 4,056,327 | 11/1977 | Daus, Jr. et al. | 403/172 |
| 4,149,481 | 4/1979 | Leber | 114/39 |
| 4,278,042 | 7/1981 | Lindquist | 114/218 |
| 4,294,184 | 10/1981 | Heinrich | 114/61 |
| 4,316,424 | 2/1982 | McKenna | 114/39 |
| 4,326,475 | 4/1982 | Berte | 114/39 |
| 4,407,600 | 10/1983 | Thompson | 403/23 |

FOREIGN PATENT DOCUMENTS

| | | | |
|---|---|---|---|
| 2649577 | 5/1978 | Fed. Rep. of Germany | 114/61 |
| 3130907 | 3/1983 | Fed. Rep. of Germany | 114/39.1 |
| 1398318 | 3/1965 | France . | |
| 613880 | 12/1960 | Italy | 403/161 |
| 693829 | 8/1965 | Italy . | |
| 57-58589 | 4/1982 | Japan | 114/93 |
| 21170 | of 1892 | United Kingdom | 212/190 |
| 560851 | 4/1944 | United Kingdom . | |
| 922065 | 3/1963 | United Kingdom | 114/123 |
| 1191950 | 5/1970 | United Kingdom | 114/218 |
| 1308588 | 2/1973 | United Kingdom . | |
| 1371646 | 10/1974 | United Kingdom | 114/218 |

*Primary Examiner*—Jeffrey V. Nase
*Assistant Examiner*—Thomas J. Brahan
*Attorney, Agent, or Firm*—Jeffers, Hoffman & Niewyk

[57] ABSTRACT

A watercraft comprising a plurality of spaced-apart flotation members a corresponding plurality of elongate spar members, and a main mast. The spar members and the main mast each have opposite proximal and distal ends. A juncture means receives the proximal ends of each of the spar members and the main mast member. The watercraft further includes means for propelling itself. A plurality of spar attachment means connects each spar to its corresponding flotation member. The attachment means includes an elongate mounting bracket having an aperture attached to the distal end of its corresponding spar member, and a mounting assembly attached to its corresponding flotation member so as to retain the bracket by its aperture so that the spar member is connected to its corresponding flotation member so as to permit limited omni directional movement of the spar member relative to the corresponding flotation member.

8 Claims, 27 Drawing Figures

WATER SAILING CRAFT

BACKGROUND OF THE INVENTION

The present invention relates to a watercraft, and more particularly, to a watercraft of exceptional stability and utilizing a derrick with a working angle of about 120°.

Water crafts have been utilized for travel and for hauling loads from the time of early recorded history. A great many designs have been developed in order to accomplish the specific objective of the watercraft, whether it be intended for commercial usage or for pleasure. Factors which enter into the design of a sailing watercraft include whether the watercraft is to be propelled by wind, a motor, or a combination of wind with an auxiliary motor, the obtainable speed in a given wind, stability in high winds, the amount of sail which can be carried in high winds, the total durability, and the like.

A common design of sailing watercrafts comprises a single hull which is generally elongated in shape and provided with a centerboard or keel. One or more masts connected to the hull carry the sails. Before the advent of steamships, large ocean-going commercial vessels used an extremely complex system of masts, yard arms, stays, etc., to propel the large hull and cargo carried therein. One of the difficulties with vessels having only one hull is that the large contact area between the hull and the water results in a very substantial frictional drag which reduces the speed of the vessel. This drag is further increased by the necessity of having a centerboard in order to prevent overturning of the vessel in high winds.

Vessels having multiple hulls, such as catamarans and trimarans, represent an attempt to reduce the frictional drag between the hull and the water. The mast or masts and rigging of these vessels are supported on a plurality of pontoons or floats. The pontoons or floats are generally widely spaced from each other and usually have a relatively small wetted surface when compared with a conventional single-hulled vessel. While multi-hulled vessels are capable of higher speeds than conventional single-hulled vessels, they are more difficult to maneuver, especially when attempting to turn into the wind. The hulls of these multi-hulled vessels are generally interconnected by means of a framework of elongated tubular members. The multi-hulled vessel, therefore, is generally not as durable as a single-hulled vessel.

U.S. Pat. No. 3,395,664 issued on Aug. 6, 1968, to Greenburg et al., appears to show a sailing vessel having a rigid frame which is polyhedral in shape. In one embodiment, (FIG. 1) the frame comprises six interconnected tubular members defining a triangular face connected to three buoyant support members, and three triangular sides connected at an apex. In another embodiment (FIG. 5), a lower tetrahedral frame made of six interconnected tubular members has a vertical mast connected to the apex thereof. The mast is supported by a plurality of stays connected to the three corners of the triangular base. A problem with the first discussed embodiment is that it appears that the frame relies for support solely on the six interconnected tubular members. This arrangement makes the vessel unsuitable for operation in high winds or rough seas. In the second embodiment, it appears that the mast is merely connected to the polyhedral frame and does not function as one of the structural members, thereby resulting in an unbalance of the forces so as to substantially reduce the durability and overall strength of the vessel.

U.S. Pat. No. 3,991,694 issued to Black on Nov. 16, 1976, appears to show a semi-rigid wind propelled vessel. The mast of this vessel is similarly connected to the apex of a polyhedral frame and is supported by a plurality of stays connected to the corners of the triangular base of the frame. The stresses and forces in the watercraft of Black appear to unequally distributed, and thus, would render this vessel of Black unsuitable for ocean-going use. The vessel disclosed in this U.S. patent does not appear to teach a sea crane or support for an elevated platform.

U.S. Pat. No. 4,326,475 issued on Apr. 27, 1982 to Berte appears to show a sailboat with the mast similarly connected to the apex of a polyhedral frame as in U.S. Pat. No. 3,991,694. This reference, also, does not appear to teach a suspended sea crane or support for an elevated sea platform.

SUMMARY OF THE INVENTION

It is an object of the invention to provide an improved watercraft of exception stability.

It is another object of the invention to provide a watercraft which has an improved resistance to heeling.

It is another object of the invention to provide an improved watercraft of exceptional stability which has the capability of utilizing a derrick having a working angle of 120°.

It is an object of the invention to provide an improved watercraft of exceptional stability having a load lifting performance wherein the direction of wave approach has no meaningful influence thereon.

It is an object of the invention to provide an improved watercraft which has great flexibility in being modified so as to accommodate a large variety of working applications.

The invention, in one form thereof, is a watercraft comprising a plurality of spaced-apart flotation members and a plurality of elongate spar members wherein each of the spar members corresponds to one of the flotation members. Each of the spar members as well as the main mast member have opposite proximal and distal ends. The watercraft further includes a juncture means for receiving the proximal ends of each of the spar members and the main mast member. The watercraft further includes a means for propelling the watercraft.

A plurality of spar attachment means connect each spar to its corresponding flotation member. Each of the spar attachment means includes an elongate mounting bracket containing an aperture attached to the distal end of its corresponding spar member. The spar attachment means further includes a mounting assembly attached to its corresponding flotation member wherein the mounting assembly retains the bracket by the aperture so that the spar member is connected to its corresponding flotation member in such a fashion so as to permit limited omni-directional movement of the spar member relative to its corresponding flotation member.

In another form thereof, the invention is a watercraft comprising a plurality of spaced-apart flotation members and a plurality of elongate spar members wherein each of the spar members corresponds to one of the flotation members. A main mast as well as each of the spar members has opposite ends. The watercraft further includes a juncture means for receiving the approximate end of each of the spar members and the main mast member. The watercraft also includes a means for propelling itself.

The watercraft further includes a stabilization means for flexibly stabilizing the plurality of spaced-apart flotation members. The stabilization means includes a line extending from the distal end portions of each adjacent pair of spar members and means for attaching each of the lines to the adjacent pair of flotation members corresponding to the adjacent pair of spar members.

In another form thereof, the invention is a watercraft comprising a plurality of spaced-apart flotation members and a plurality of elongate spar members wherein each of the spar members corresponds to one of the flotation members. Each spar member and a main mast member has opposite ends. A juncture means receives the proximate end of each of the spar members and the main mast member. The watercraft further includes a means for propelling the watercraft as well as a stabilization means for flexibly stabilizing a plurality of spaced-apart flotation members. The watercraft finally includes a derrick assembly movably attached to the juncture means so as to have a 120° working angle.

The above-mentioned and other features and objects of this invention, and the manner of attaining them, will become more apparent and the invention itself will be better understood by reference to the following description of an embodiment of the invention taken in conjunction with the accompanying drawings.

DETAILED DESCRIPTION OF SPECIFIC EMBODIMENTS

Figure 1:
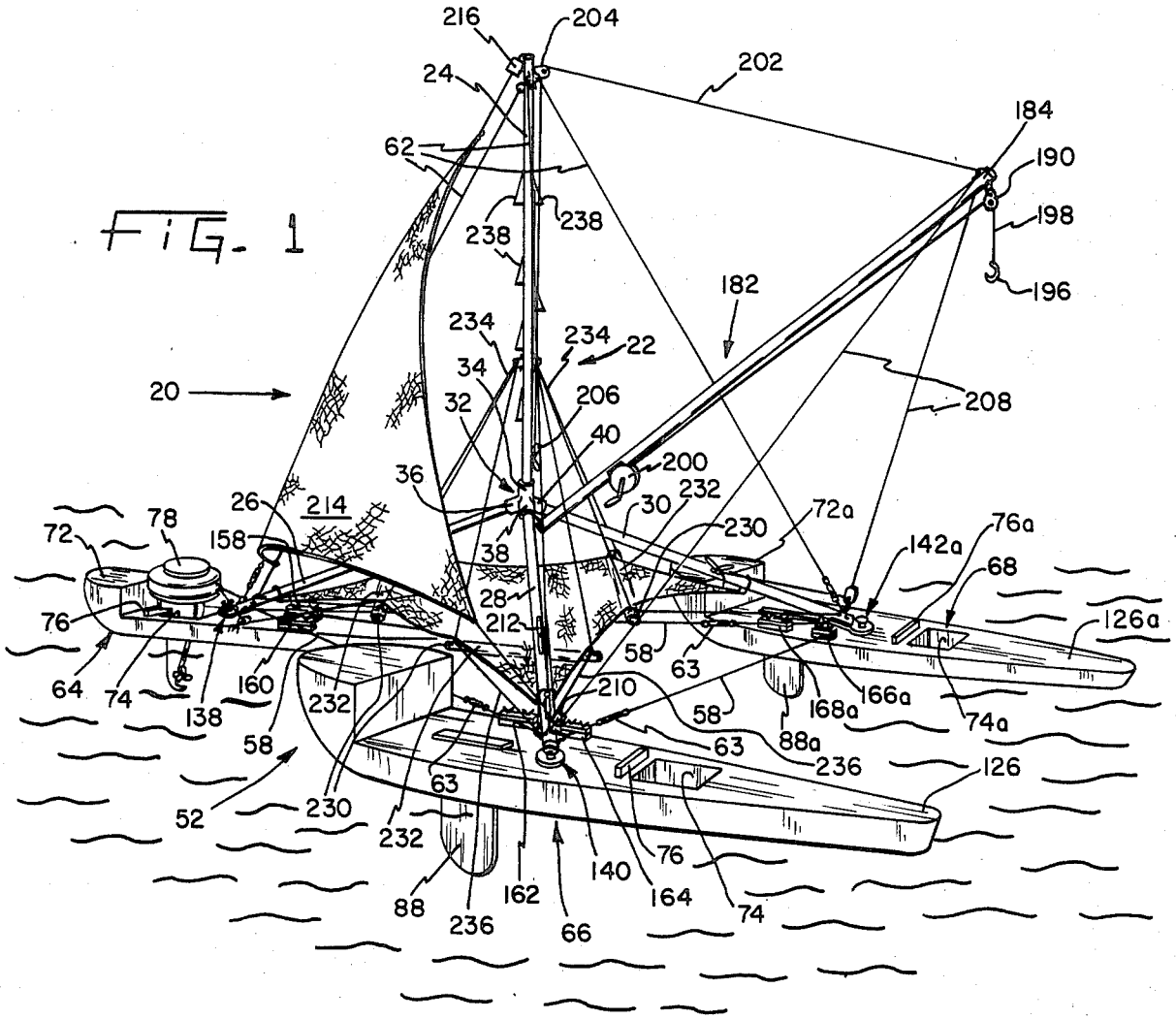
FIG. 1 is a perspective view of one specific embodiment of the watercraft of the invention.

FIG. 1 illustrates a watercraft 20 which is one specific embodiment of the present invention. Watercraft 20 has frame 22 which comprises a spaced hull assembly 52 and four substantially rigid equilength spar members 24, 26, 28 and 30. Spar members 24, 26, 28 and 30 connect at their proximal ends to a juncture 32 such that spar members 24, 26, 28, 30 form substantially equal angles of approximately 120° relative to one another. Spar 24 is generally vertically disposed. Spars 26, 28 and 30 are each generally angularly disposed as will become more apparent hereinafter.

Hereafter, in order to make the description of watercraft 20 more easily understood, spar member 24 will be designated as the "vertical spar", spar member 26 will be designated as the "bow spar", spar member 28 will be designated as the "port spar", and spar member 30 will be designated as the "starboard spar". It is to be understood that spar members 24, 26, 28, 30 are substantially identical. All of spars 24, 26, 28, 30 are of hollow construction and made of a lightweight, strong material such as aluminum, fiber glass or the like.

Figure 10:
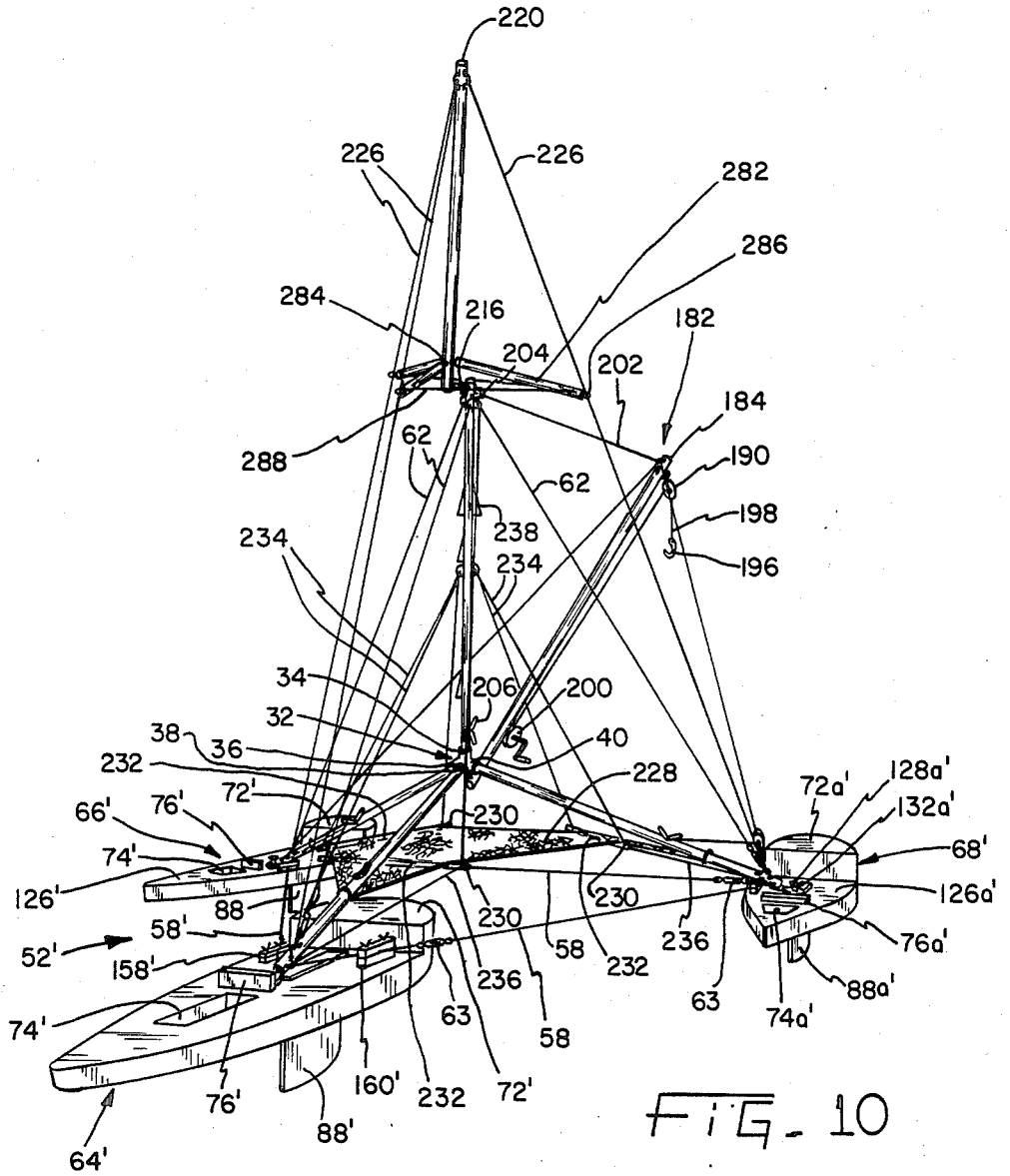
FIG. 10 is a perspective view of another specific embodiment of the watercraft of the invention.
Figure 11:
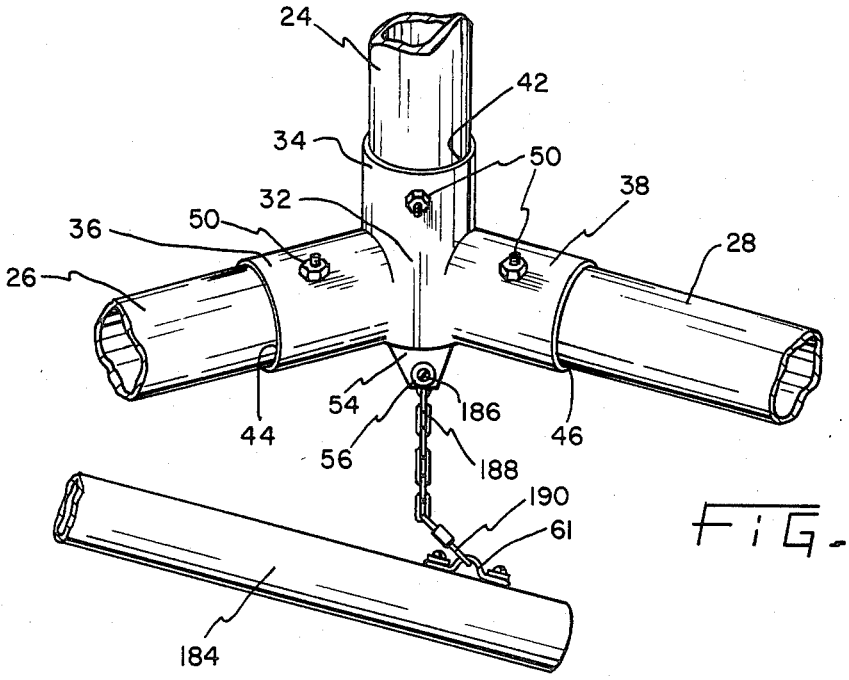
FIG. 11 is a detailed fragmentary isometric view of the juncture of the spars with a derrick attached.

FIGS. 1, 10 and 11 illustrate juncture 32. Juncture 32 includes integral arms 34, 36, 38 and 40 having openings 42, 44, 46 and 48, respectively. Each of openings 42, 44, 46, 48 receive a proximal end of one of spar members 24, 26, 28, 30, respectively. Fasteners 50, such as bolt and nut combinations illustrated in FIG. 11, securely hold proximal ends of spar members 24, 26, 28, 30 within integral arms 34, 36, 38, 40, respectively. A flange portion 54 extends substantially downward from the bottom portion of juncture 32. Flange portion 54 can be integral with juncture 32 and flange portion 54 has transverse flange opening 56 therethrough.

Watercraft 20 includes a trio of primary stays 58. Each primary stay 58 has opposite ends. A snap ring 60 is connected at each opposite end of each primary stay 58. A primary stay 58 extends between so as to connect corresponding adjacent distal end portions of spar members 26, 28, 30. In this manner, primary stays 58 define a substantially equilateral triangular supportive base for frame 22. Each snap ring 60 attaches to its corresponding semi-circular eye strap 61 which is secured near to and equidistant from the distal end portion of each of spar members 24, 26, 28, 30. See FIG. 12. Other nautically suitable connections may be made without departing from the scope of the present invention.

Watercraft 20 further includes a trio of secondary stays 62 as illustrated in FIGS. 1 and 10. One end of each secondary stay 62 connects to the distal end portion of spar member 24. The opposite end of each secondary stay 62 connects to the distal end of its corresponding one of spar members 26, 28, 30. These connections may be made in a manner similar to which primary stays 58 connect to the distal end portion of each of spar members 26, 28, 30. It is important to note that stays 58 and 62 connect to respective distal end portions of spar members 24, 26, 28, 30, by semi-circular eye straps 61 secured to spar members 24, 26, 28, 30 at points equidistant from juncture 32. By interconnecting spars 26, 28, 30 via the primary stays 58, and spar member 24 with spar members 26, 28, 30 via the secondary stays 62, frame 22 takes on a substantially rigid tetrahedral shape. Also, tensioners 63 such as turnbuckles or the like, may be attached or fitted to primary stays 58 and secondary stays 62.

As thus described, the structural integrity of basic frame 22 of the watercraft is complete. Primary stays 58 and secondary stays 62 can be made taut by removing any slack with tensioners 63. Frame 22 balances any forces against it in a manner similar to that of applicant's craft described in U.S. patent application Ser. No. 109,085, filed Jan. 2, 1980, as a result of the substantially tetrahedral shape of frame 22. Spar members 24, 26, 28, 30 are each angularly disposed relative one to the other at an angle of about 120°, and the distal end portions of each of spar members 24, 26, 28, 30 interconnect by taut, flexible stays 58 and 62. As a result, this structure has greater resistance to heeling. It will transform lateral forces projected against the frame 22 into compressional forces through spar members 24, 26, 28, 30 to juncture 32 where the proximal end portions of the spar members absorb and dissipate such compressional forces.

Referring now to FIGS. 1–6 and 12, the spaced hull assembly 52 of watercraft 20 will now be described. Hull assembly 52 includes three spaced-apart substantially surfboard-like self-stabilized flotation members or pontoons generally designated as 64, 66 and 68. In order to make the description of watercraft 20 more easily understood, pontoon 64 will be identified as the bow pontoon, pontoon 66 will be identified as the port pontoon, and pontoon 68 will be identified as the starboard pontoon. Pontoons 66 and 68 are substantially identical so that a description of the port pontoon 66 will suffice for a description of the starboard pontoon 68. In the drawings, the corresponding elements of starboard pontoon 68 to port pontoon 66 will have identical reference numeral but with the suffix "a".

Pontoon 66 has a generally teardrop-shaped body 70, and may be made of a lightweight plastic material such as styrofoam or a structural foam molded around a wood plank (not illustrated). Pontoon 66 may also be constructed so as to be foam-filled with a fiber glass skin. Pontoon 66 has an elevated nose section 72 which provides added buoyancy to the watercraft. Nose section 72 also acts as a shield against heavy seas. In calm weather, elevated nose section 72 may provide additional passenger seating for the watercraft. Port pontoon 66 further includes a centerboard well 73 intermediate elevated nose section 72 and the point of attachment of port spar member 28 to port pontoon 66. Centerboard member 88 slidably rides in centerboard well 73 for vertical displacement therein to maintain the lateral stability of watercraft 20.

Figure 4:
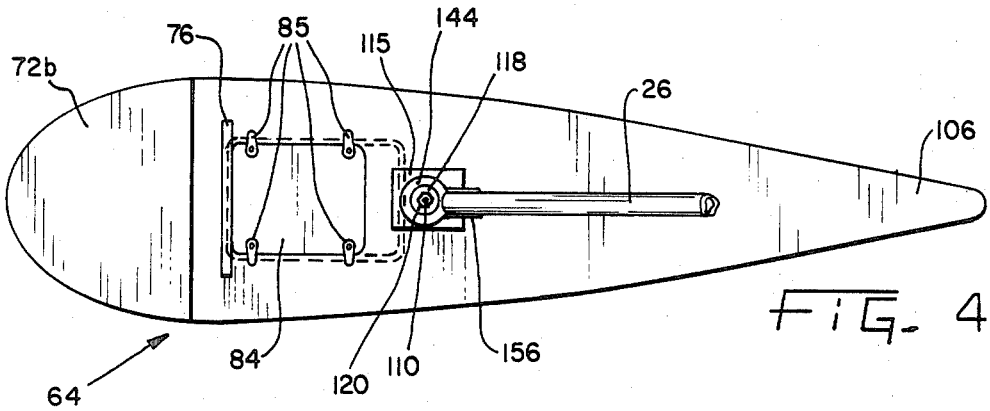
FIG. 4 is a top plan view of a flotation member with an engine well.
Figure 5:
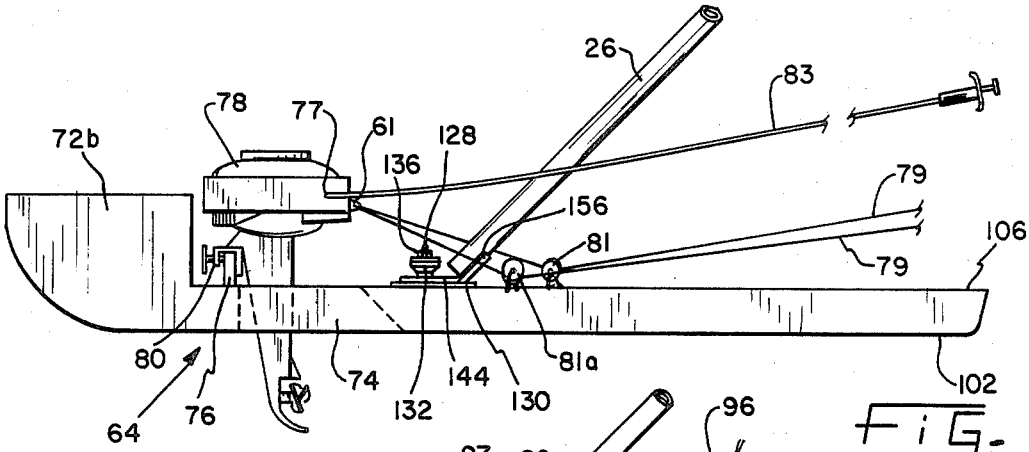
FIG. 5 is a side elevational view of a flotation member with an engine.
Figure 6:
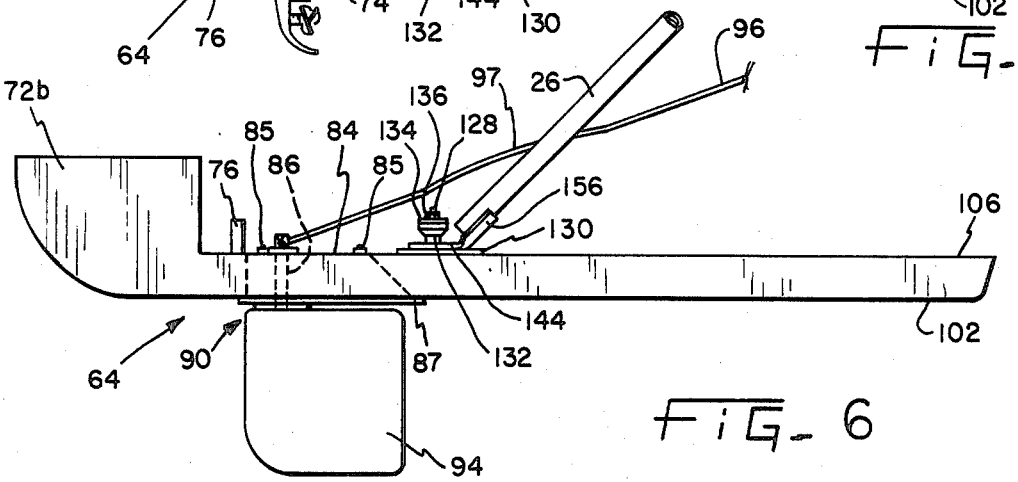
FIG. 6 is a side elevational view of a flotation member with a tiller.

Bow pontoon 64 has an engine well 74 as illustrated in FIGS. 4–6. Bow pontoon 64 further includes a motor transom 76 substantially intermediate the rearward portion of elevated nose section **72*b* and the point of attachment of bow spar member 26 to the bow pontoon. Engine well 74 receives a motor 78, such as an outboard motor, with a motor bracket 80 and a handle 82. See FIG. 5A. Motor bracket 80 secures motor 78 to motor transom 76. Handle 82 steers watercraft 20 when using motor 78 to propel watercraft 20. Motor 78 can be removed from engine well 74 to rest on motor transom 76 when watercraft 20** is under sail.

Engine well plug 84 can be used to fill the opening of engine well 74 when the engine is not in use. Engine well plug 84 inserts upward from the bottom of pontoon 64 into engine well 74. Securing devices 85, such as a toggles on an upper surface of engine well plug 84 hold engine well plug 84 securely within engine well 74. See FIGS. 4, 6 and **6*b*. Engine well plug 84 has bottom flange 87 extending around the outer perimeter of engine well plug 84. Bottom flange 87 extends beyond the opening of engine well 74 in the bottom of pontoon 64** to effectively seal out water.

Figure 6A:
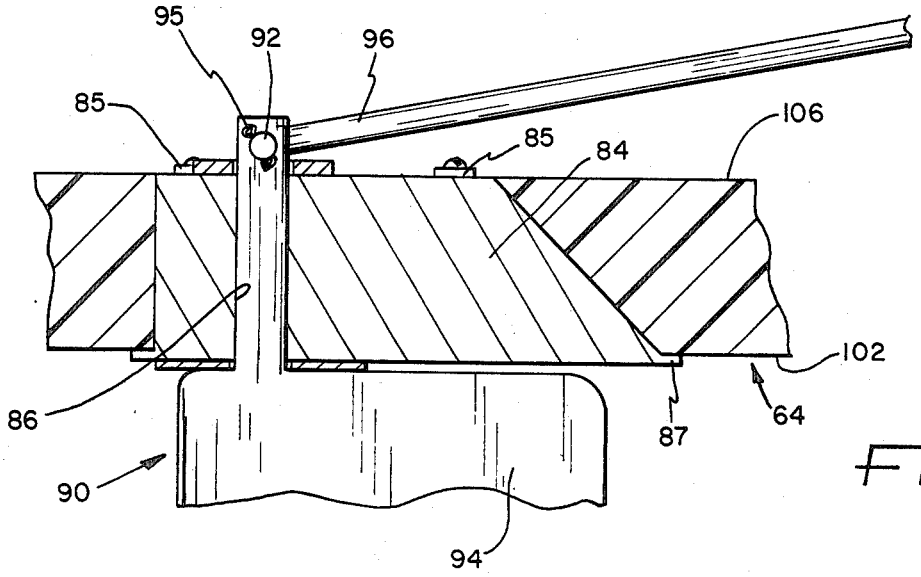
FIG. 6A is a detailed fragmentary sectional view of FIG. 6.
Figure 6B:
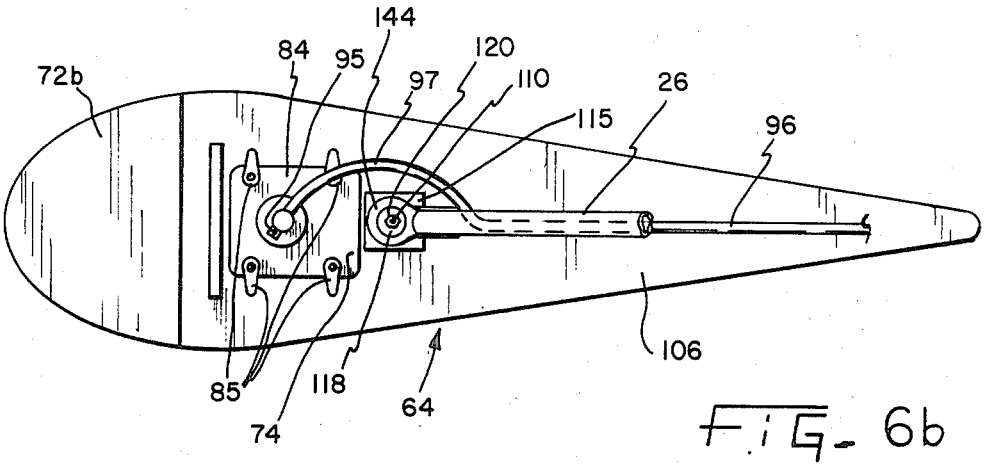
FIG. 6B is a top plan view of FIG. 6.

When watercraft 20 is under sail, engine well plug 84 replaces outboard motor 78 in engine well 74. Engine well plug 84 has opening 86 therein. A rudder assembly 90 is rotatably mounted to plug 84 at opening 86. Rudder assembly 90 includes a rudder shaft 92 having opposite ends. A blade 94 is attached to one end of shaft 92. Rudder shaft 92 can be inserted through the bottom of opening 86 so as to protrude through pontoon 64. Shaft 92 can be connected to a steering device such as tiller 96 as illustrated in FIGS. 6, 6A and 6B. In this specific embodiment, steering and lateral resistance is provided to achieve all points of sail up to 70 percent of the wind. Rudder blade 94 and the two centerboards 88 preferably should be of equal size.

The specific embodiment illustrated in FIG. 1 provides that the port and starboard stern pontoons each include an engine well 74 and **74*a*, respectively, and a transom 76 and 76*a*, respectively, in a rearward portion of each stern pontoon. A motor 78 can be used in each of stern pontoons 66 and 68 and a motor removed from or not used in the bow pontoon. When using this alternative motor arrangement, bow pontoon 64 would have engine well plug 84 and rudder 90 inserted in the bottom portion of engine well 74, and the watercraft 20 would be steered by a steering device such as tiller 96. A retainer such as a cotter pin 95, (FIG. 6A), holds steering device 96 within a transverse opening (not shown) through a top portion of rudder shaft 92**.

FIG. 10 illustrates another specific embodiment of the invention wherein the watercraft 20' has port and starboard bow pontoons 66', 68', respectively, and a stern pontoon 64'. A motor 78 can be used in each of the two bow pontoons 66', 68' or in the stern pontoon 64' as illustrated in FIG. 10 to power the watercraft. When using an engine in back of bow pontoons 66', 68', the single stern pontoon 64' would carry the engine well plug 84 with rudder assembly 90 and tiller 96 to steer the watercraft 20. Conversely, one motor can be used in the stern pontoon 64' with centerboards in position on the port and starboard bow pontoons 66', 68', to provide lateral stability.

FIGS. 5, 5A, 6 and 6A illustrate an arrangement for steering the watercraft 20 from an almost unlimited number of locations on watercraft 20. Remote steering of watercraft 20 by use of tiller 96 is also possible. Only the length of tiller 96 limits the positions from which watercraft 20 can be steered. Tiller 96 has an arcuate portion 97 to pass around the bow spar 26. Motor cable 79 extends through pulley 81 and connects to motor handle 82. Motor cable 79' extends through pulley **81*a* on the opposite side of pontoon 64 and also connects to motor handle 82. The opposite ends of cables 79, 79' are available to connect to any of selected locations throughout the extent of watercraft 20 for remotely steering motor 78. Remote control of motor 78 is limited only by the length of motor cables 79, 79'**.

Figure 5A:
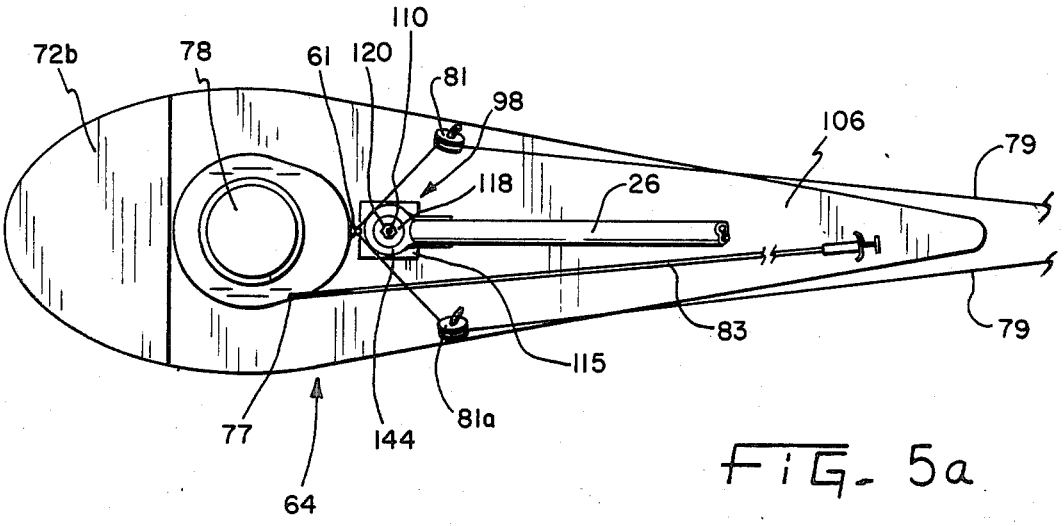
FIG. 5A is a top plan view of FIG. 5.

FIGS. 5 and 5A also illustrate an arrangement for starting motor 78 from a remote location on watercraft 20. Free standing cable 83 connects to a starting device 77 on motor 78 for remotely starting motor 78. Remote starting of motor 78 is limited only by the length of free standing cable 83.

When using outboard motor 78, the operator steers watercraft 20 by pulling on the end of one of cables 79, 79' attached to motor handle 82 or to a single eye strap 61 attached to the rear center portion of the base of the engine cover is illustrated in FIGS. 5 and 5A. It is important to note that when used in this manner, outboard motor is in the front portion of the bow pontoon 64 as illustrated in FIG. 1, therefore, the steering points are in the back of the motor instead of the front.

A selected mounting assembly is secured to the upper surface of each of pontoons 64, 66 and 68 at substantially the center of buoyancy of the pontoon. The mounting assembly projects from the upper surface of one of each of pontoons 64, 66, 68, to hold the distal end portion of the spar member tethered thereto. This tethering arrangement allows a short radius of movement of the pontoon at substantially its point of lift.

Figure 13:
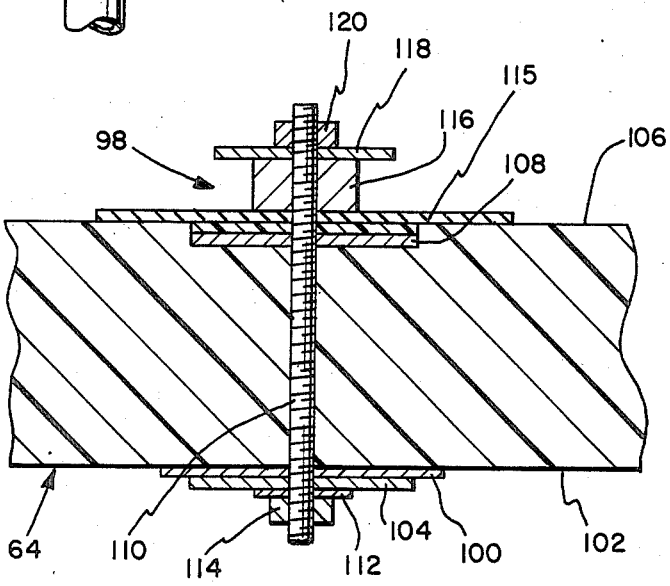
FIG. 13 is a fragmentary detailed sectional view of one specific form of a mounting assembly secured on a flotation member.

FIG. 13 illustrates a mounting assembly generally designated as 98, a preferred form for bow pontoon 64. The attachment of mounting assembly 98 is preferred when heavy lifting operations are anticipated to produce large upthrusting forces to the pontoon's mounting assembly. Mounting assembly 98 comprises a pad 100 adjacent the bottom surface 102, of bow pontoon 64, and a lower plate 104 positioned underneath pad 100. Lower plate 104 and pad 100 each have a transverse opening contained therein which are in general axial alignment. On the upper surface 106 of bow pontoon 64, upper plate 108 is resined (covered with resin or fiber glass) below upper surface 106. Upper plate 108 has a transverse opening therethrough which is in general axial alignment with the openings in pad 100 and lower plate 104. A upstanding fastener such as a threaded bolt 110 extends upwardly through the openings in lower plate 104, pad 100, and upper plate 108 to extend above upper surface 106. A washer 112, and a nut 114, on threaded bolt 110 secure lower plate 104 to bottom surface 102. A pad 115, preferably made of a cushion material such as rubber, has a transverse opening therethrough and fits over the upper portion of threaded bolt 110 to lie against upper surface 106. A coupling member such as a bushing 116 fits over the upwardly extending portion of threaded bolt 110, a washer 118, fits over bushing 116 and a nut 120, threadably secures washer 118 and bushing 116 in position.

Figure 2:
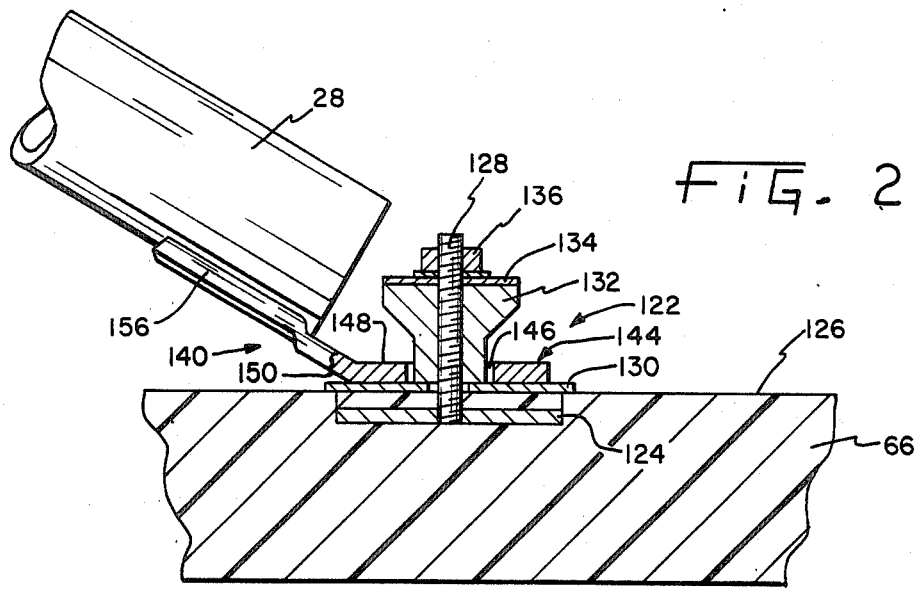
FIG. 2 is a fragmentary detailed sectional view of one specific fixture used to attach the distal end of a spar to a mounting assembly on a flotation means.
Figure 3:
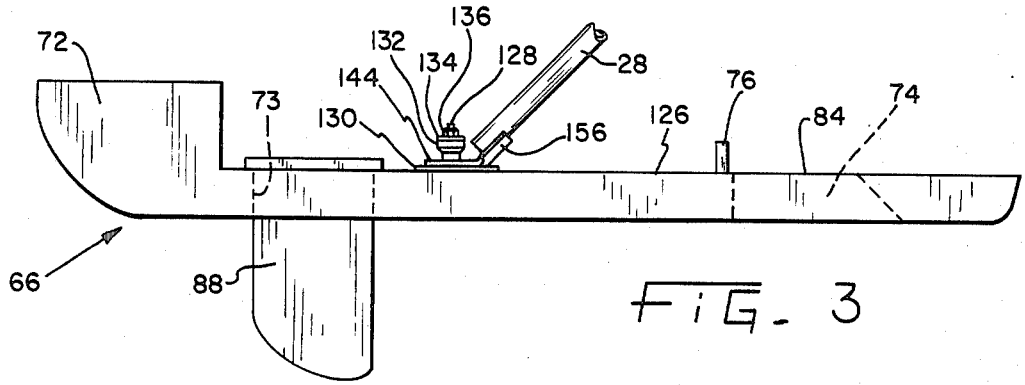
FIG. 3 is a side elevational view of a flotation member with a rudder.

An alternate mounting assembly as illustrated in FIG. 2 is generally designated as 122. Mounting assembly 122 is suitable for use with a stern pontoon, such as stern pontoon 64' as illustrated in FIG. 10 or as port and starboard pontoons 66 and 68 of the specific embodiment illustrated in FIG. 1. Mounting assembly 122 has a plate member 124 positioned in a contoured depression in pontoon 66. Plate member 124 is resined (covered with resin) so as to be embedded under upper surface 126 of pontoon 66. A upstanding fastener such as a threaded bolt 128 is welded or otherwise secured to plate member 124 and extends vertically upward therefrom and through upper surface 126. Cushion 130 lies on upper surface 126 and has a transverse opening contained therein which threaded bolt 128 passes. A coupling member such as a bushing 132 and a washer 134 are slidably received on the upper portion of threaded bolt 128. A nut 136 is threadably secured to threaded bolt 128 so as to hold bushing 132 securely against cushion 130.

Bushings 116 and 132 are preferably made of nylon, rubber, polypropylene, or the like so as to protect threaded bolts 110 and 128, respectively. Cushion 130 is preferably of like material to bushing 132. Washer 134 is preferably a stainless steel washer, and plate members 104, 108 and 124 are preferably circular stainless steel plates.

Substantially identical spar attachment fixtures 138, 140, 142, are secured on the distal end portion of spar members 26, 28, 30, respectively, as illustrated in FIG. 1. Spar attachment fixtures 138, 140, 142 tether spar members 26, 28, 30, respectively to pontoons 64, 66, 68 respectively to allow a short radius of movement of pontoons 64, 66 and 68. This tether arrangement will be described in detail hereinbelow. A description of spar attachment fixture 140 will suffice for a description of the other two.

Spar attachment fixture 140 is illustrated in detail in FIGS. 2 and 7–9. Fixture 140 is preferably made of stainless steel. Fixture 140 is an elongate mounting bracket such as an elongate member having a connecting portion such as a tether portion 144 defining an aperture such as a transverse opening 146 contained therein, a top surface 148, and a bottom surface 150. Transverse opening 146 receives a bushing 152 with bottom flange 154 through bottom surface 150. Bushing 152 extends above top surface 148. See FIG. 9. An integral mounting portion such as a proximal arm portion 156 of spar attachment fixture 140 receives any suitable type of fasteners 157 for securing proximal arm 156 to the distal end portion of one of the spar members 26, 28, 30.

Figure 8:
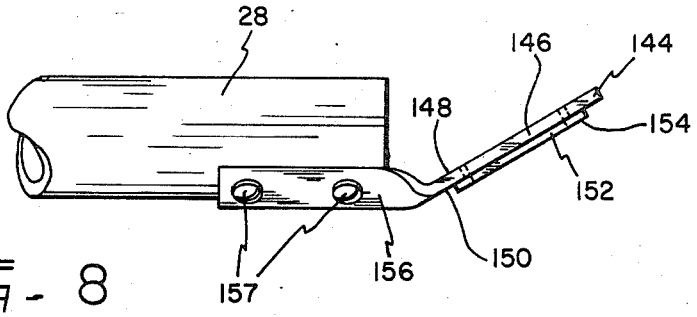
FIG. 8 is a fragmentary side elevation view of a spar attachment fixture attached to the distal end portion of a spar.
Figure 9:
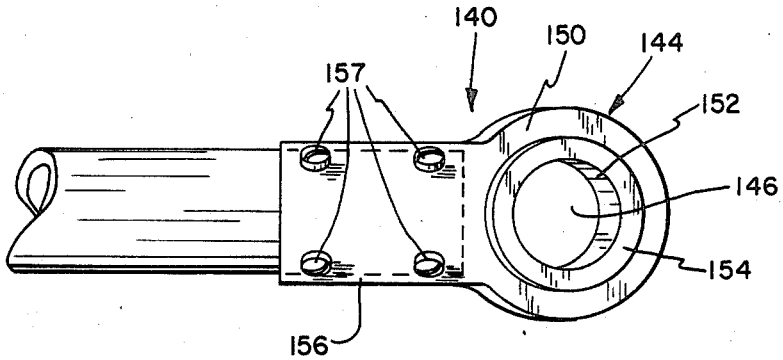
FIG. 9 is a fragmentary bottom plan view of a spar attachment fixture attached to the distal end portion of a spar.

As FIGS. 2 and 8 illustrate, proximal arm 156 compliments the distal end of its corresponding spar member in that it follows the contour of a segment of the distal end portion of one of spar members 26, 28, 30, and tether portion 144 slightly offsets from proximal arm 156 to lie in a plane substantially parallel with the upper surface of one of pontoons 64, 66, 68. It should be noted that tether portion 144 offsets adequately from proximal arm 156 to maintain the angular orientation of each of downwardly oriented spar members 26, 28, 30.

Figure 7:
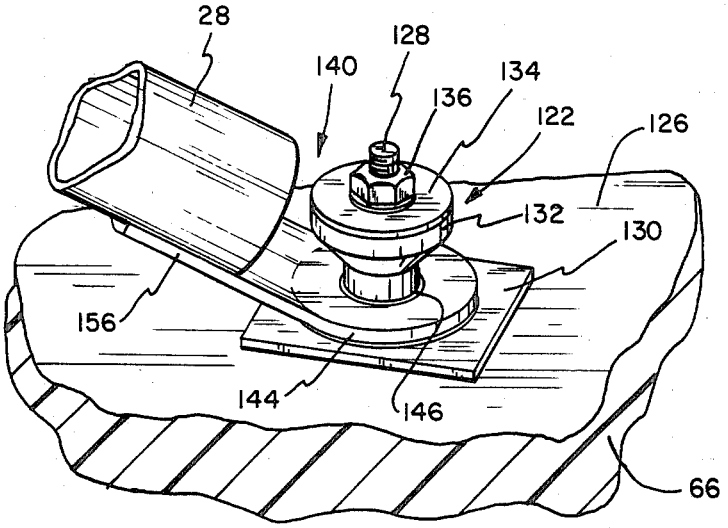
FIG. 7 is a detailed fragmentary isometric view of a spar tethered to a flotation member.

FIGS. 2 and 7 illustrate spar attachment fixture 140 tethering spar 28 to port stern pontoon 66. Transverse opening 146 fits loosely around threaded bolt 128 and tether portion 144 rests on cushion 130. Bushing 132 and washer 134 are received on the upper portion of threaded bolt 128 and fit loosely within transverse opening 146 to rest on cushion 130. Nut 136 holds washer 134 and bushing 132 in place on the upper portion of threaded bolt 128 to keep spar attachment fixture 140 from slipping off mounting assembly 122. Although the diameter of transverse opening 146 is greater than the bottom portion of bushing 132, spar attachment fixture 140 does not slide off mounting assembly 122 because the uppermost portion of bushing 132 is of a diameter greater than the diameter of transverse opening 146.

Providing transverse opening 146 with a slightly greater diameter than the outer diameter of the lower portion of either of bushings 116 and 132 allows approximately 50° of articulation from the horizontal position for each of the pontoons. This arrangement of one of mounting assemblies 98, 122 with one of spar attachment fixtures 138, 140, 142 tethers spar members 26, 28, 30 to the center of buoyancy of pontoons 64, 66, 68, respectively to allow each of pontoons 64, 66 and 68 a short radius of movement. This tethering provision permits articulation of pontoons 64, 66, 68 at their connection points, and it also enhances the predictability of the response of watercraft 20 to the sea state. This increased predictability factor simplifies project planning and reduces costly downtime.

FIGS. 18, 18A, 18B and 18C, illustrate another form of mounting assembly, spar connection tie-down fixture 240. Fixture 240 requires a circular well 241 in the top surface of the pontoons 64, 66, 68 at substantially the center of buoyancy or point of lift. See FIG. 18C. Tie-down fixture 240 includes a circular plate 242, a solid bar 244, a hollow cylindrical cup 246, a tubular section bushing 248 and a tie-down cable 250. Circular plate 242, solid bar 244, cylindrical cup 246 and tie-down cable 250 are preferably made of stainless steel. Opposite ends of the tie-down cable 250 project upwardly from tie-down fixture 240 to connect to tether portion 144. Since tie-down fixture 240 is substantially identical and identically mounted on each of pontoons 64, 66, 68, a description of the mounting of tie-down fixture 240 on pontoon 66 will serve as a description of mounting tie-down fixture 240 on pontoons 64, 68.

Circular plate 242 has a transverse circular opening therethrough with hollow cylindrical cup 246 secured flush to the transverse circular opening on the under surface of circular plate 242. See FIG. 18A. Hollow cylindrical cup 246 can be secured to circular plate 242 by any suitable securing method such as welding. Hollow cylindrical cup 246 closes the open circular well 241 to prevent water from migrating into the core of pontoon 66, and it provides support for tubular section bushing 248. The upper end of hollow cylindrical cup 246 is open and has at least two oppositely disposed aligned notches 246' and 246'' on its rim. The notches 246', 246'' fit around and support solid bar 244 which is secured to the undersurface of circular plate 242 to bisect the circular opening therethrough. Any suitable securing method such as welding can be used to secure solid bar 244 to circular plate 242.

Tubular section bushing 248, preferably is made from a section of nylon tubing. Tubular section bushing 248, has oppositely disposed channel slits 248' and 248'', which extend along the greater part of its length to provide passage around solid bar 244 bisecting the circular opening 241. This permits easy replacement of tubular section bushing 248. Thus assembled, circular plate 242, is resined or fiber glassed to the top surface of pontoon 66, as hollow cylindrical cup 246 is received in the circular open well 241. See FIG. 18B.

Figure 18A:
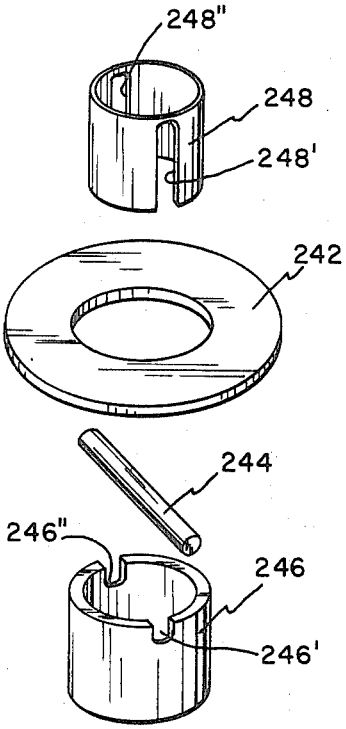
FIG. 18A is an exploded view of FIG. **18*b***.
Figure 18B:
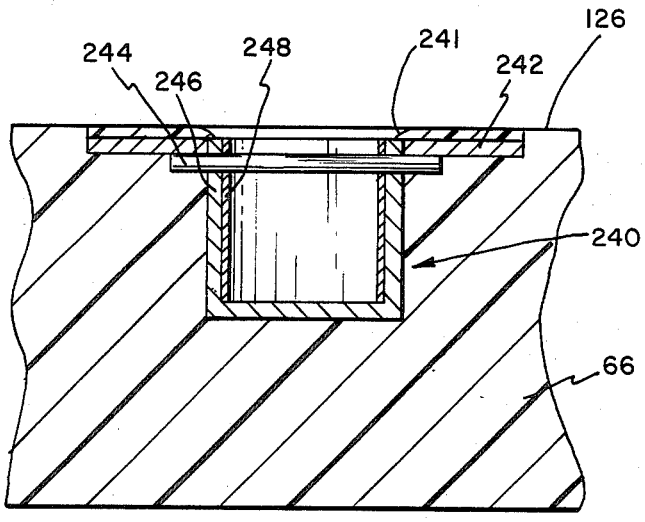
FIG. 18B is a fragmentary sectional view of one form of mounting assembly on a flotation member.
Figure 18C:
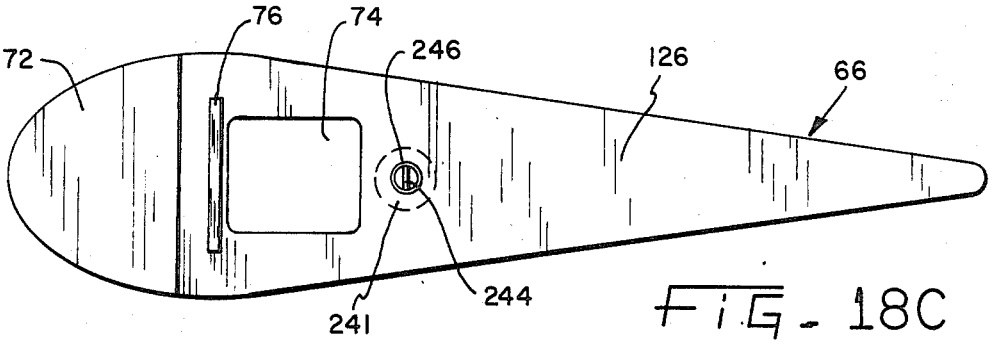
FIG. 18C is a top plan view of mounting assembly on flotation member in FIG. 19.
Figure 18:
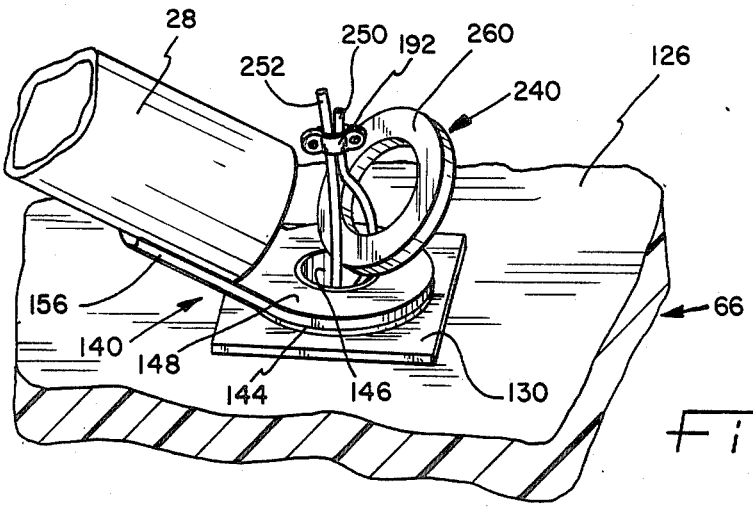
FIG. 18 is a fragmentary detailed perspective view of a spar attachment fixture tethered to the mounting assembly of FIG. 19.
Figure 19:
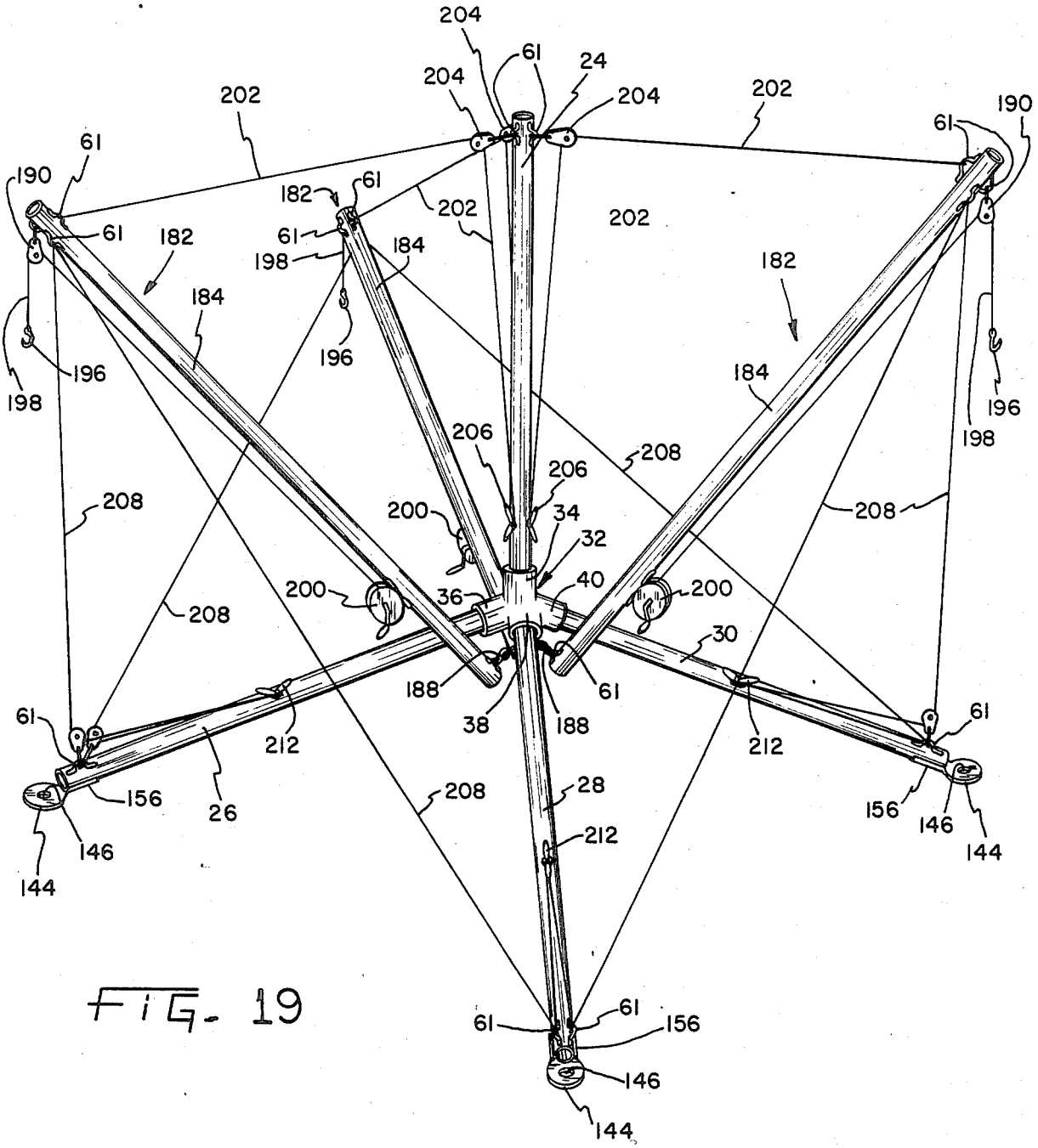
FIG. 19 is a schematic isometric view of the juncture of three articulated spar members with three derrick assemblies mounted thereto.

Tie-down cable 250, can be protected by cable sleeve 252 such as a rubber hose and the like. See FIG. 18. Tie-down cable 250 passes into hollow cylindrical cup 246 around solid bar 244 and out of cylindrical cup 246 so that opposite ends of tie-down cable 250, project upwardly out of hollow cylindrical cup 246 and are available for connecting to tether portion 144. Upwardly extending opposite ends of tie-down cable 250 pass through transverse opening 146. A large ring-like member 260 having a greater diameter than transverse opening 146 then receives the opposite ends of tie-down cable 250 on opposite portions thereof to tether spar attachment fixture 140 to pontoon 66. Each of the opposite ends of tie-down cable 250 can be connected together in any suitably nautical manner such as rope clips 192, (FIG. 18).

Figure 12:
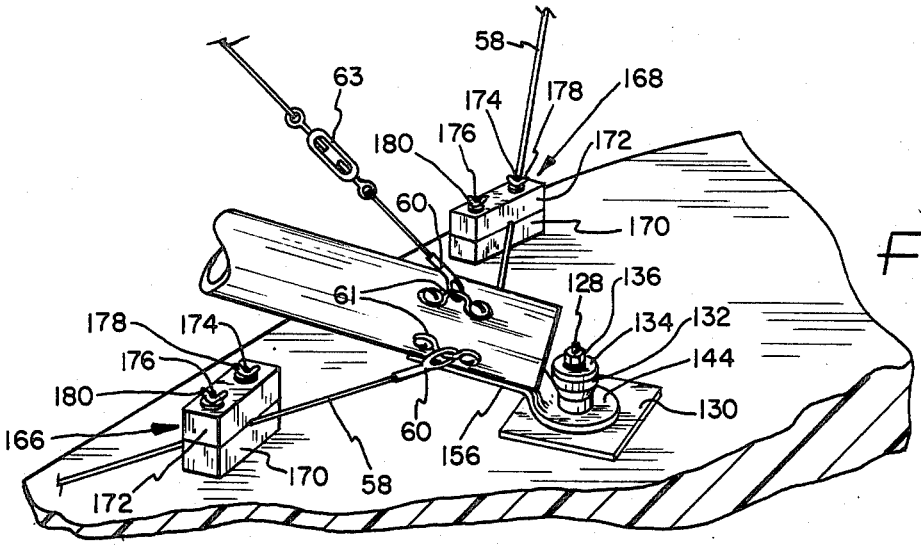
FIG. 12 is a fragmentary perspective view of a flotation member with tethered spar member and mounted devices receiving stay members.

Another manner in which pontoons 64, 66, 68, maintain their integrity in the triangular formation in either of the two specific embodiments is illustrated in FIGS. 1, 10 and 12. In addition to being tethered by spar attachment fixtures 138, 140 and 142, pontoons 64, 66, 68, respectively, are each also lashed to their corresponding adjacent ones of primary stays 58 attached to the distal end portions of spar members 26, 28, 30, respectively. Each of pontoons 64, 66, 68 has a pair of primary tether assemblies 158 (FIG. 1) 160, (FIG. 10), 162, 164, 166, and 168, respectively, for lashing each of pontoons 64, 66, 68, into its respective position relative to the other two pontoons. Primary tether assemblies 158, 160, and 162, 164 and 166, 168 are identical to one another and, therefore, a description of primary tether 168 will suffice for a description of the other primary tethers.

Primary tether assembly 168, (FIG. 12), includes a lower block 170 and an upper block 172. Blocks 170 and 172 are preferably made of polyethylene. The upper surface of lower block 170 has a groove (not shown) intermediate its opposite ends. The groove in lower block 170 has an adequate depth to maintain one of the primary stays 58 therein. Upper block 172 fits on top of lower block 170 to hold one of the primary stays 58 within the groove on lower block 170. A pair of anchored threaded bolts 174, 176 protrude upward from the top surface of pontoon 68. Bolts 174, 176 secure primary tether assembly 168 to the upper surface of pontoon 68. Threaded bolts 174, 176 protrude through opposite end portions of combined blocks 170, 172 to extend above the upper surface of upper block 172. A pair of wing nuts 178, 180 tighten on the upper protruding portion of threaded bolts 174, 176, respectively to hold blocks 170, 172 sandwiched tightly together.

Figure 17:
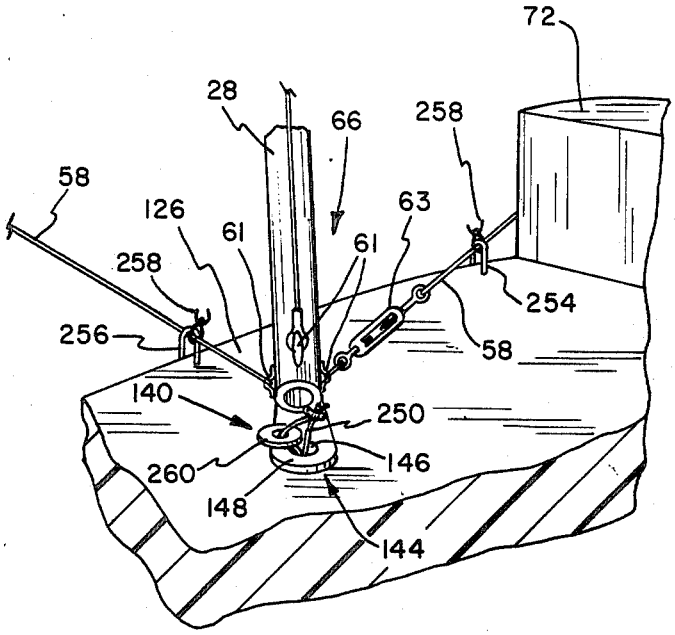
FIG. 17 is a fragmentary detailed perspective view of one specific form of a mounting assembly secured to a flotation member.

Lashing pontoons 64, 66, 68 by the primary tether assemblies 158, 160, 164, 166, 168 and 170 to primary stays 58 connected to the distal end portions of each of spar members 26, 28, 30 provides additional stability for watercraft 20 as needed in rough seas. This tethering arrangement also effectively restrains the pontoons from turning and heeling, but it still allows the pontoons to flex with the waves and swells. FIG. 17 illustrates an alternative tethering arrangement comprising a pair of loops 254, 256 made of high strength fiber glass, secured at two lashing points on each of pontoons 64, 66, 68. A rope 258, preferably of nylon, passes through one of loops 254, 256 and ties around its corresponding primary stay 58.

FIGS. 1, 10, 11 and 19 show a derrick assembly 182 attached to frame 22 via a means for connecting the derrick to the juncture means. Derrick assembly 182 includes a derrick arm 184 and a chain 188. Derrick arm 184 is suspended from flange portion 54 by a bolt 186. Bolt 186 passes through both flange opening 56 and one end of chain 188. The other end of chain 188 has a snap ring 190 which hooks onto a semi-circular eye 61 mounted on the proximal end portion of derrick arm 184. Semi-circular eye 61 can be secured to derrick arm 184 by any suitable securing means such as welding, bolting, and the like. Suspended derrick arm 184 extends substantially laterally and upwardly from juncture 32.

Derrick assembly 182 further includes a lifting means for lifting objects including derrick pulley member 190, hook 196, cable 198 and winch 200 connected to a distal end portion of derrick arm 184. Derrick hook 196 depends from derrick pulley member 190 by derrick cable 198. Winch 200 mounts on derrick arm 184 intermediate the proximal end portion and the mid portion of derrick arm 184 and controls derrick cable 198. One end of a cable 202 connects to the distal end portion of vertical spar member 24 and the opposite end of cable 202 connects to the distal end portion of derrick arm 184. Vertical spar member 24, therefore, provides boom support for derrick assembly 182. Pulley 204 mounts at the distal end portion of vertical spar member 24 to control cable 202 to raise and lower derrick arm 184. Cable 202 extends downwardly along vertical spar member 24 to a cleat 206 mounted on the proximal end portion of vertical spar 24 above juncture 32 to hold cable 202 in position. Cable 202, pulley 204 and cleat 206 generally comprise a vertical adjustment means for selectively adjusting the vertical position of the derrick.

Figure 14:
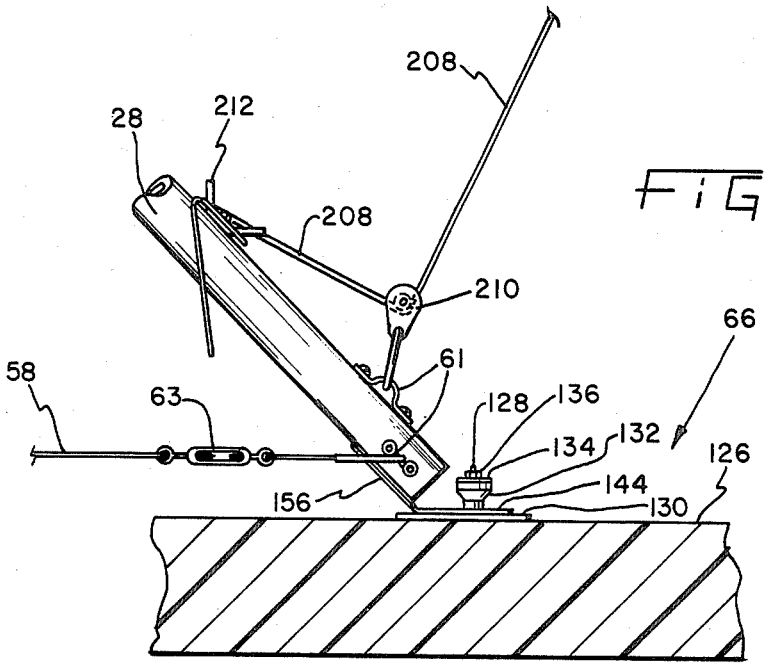
FIG. 14 is a fragmentary detailed side elevational view of a tethered spar member with attached pulley for lateral adjustment of a derrick.

Derrick assembly 182 is adjusted and controlled laterally by a lateral adjustment means including cable 208, pulley 210 and cleat 212 as illustrated in FIGS. 1 and 14. One end of a cable 208 connects to the distal end portion of port spar member 28. Cable 208 extends from port spar member 28, connects to distal end portion of derrick arm 184, and then extends downwardly to connect to distal end portion of starboard spar member 30. Pulley 210 receives cable 208 at distal end of port spar member 28 for lateral adjustment of derrick arm 184. One end of cable 208 which extends through pulley 210 attaches to cleat 212 on port spar member 28.

One end of sail 214, (FIG. 1), attaches to the distal end of vertical spar 24. Sail 214 can be furled by any ordinary furling device positioned along cable 202, and the sail can be unfurled on either of the port or starboard spar members 28, 30. In this regard, the sail works like a jib in a conventional sailboat. This invention, in one form thereof, uses jib Furling Gear System 250, from Shaffer Marine's 1983 Catalog. Furling drum 216 is mounted on the distal end of vertical spar member 24 as described in detail hereinbelow.

Figure 16:
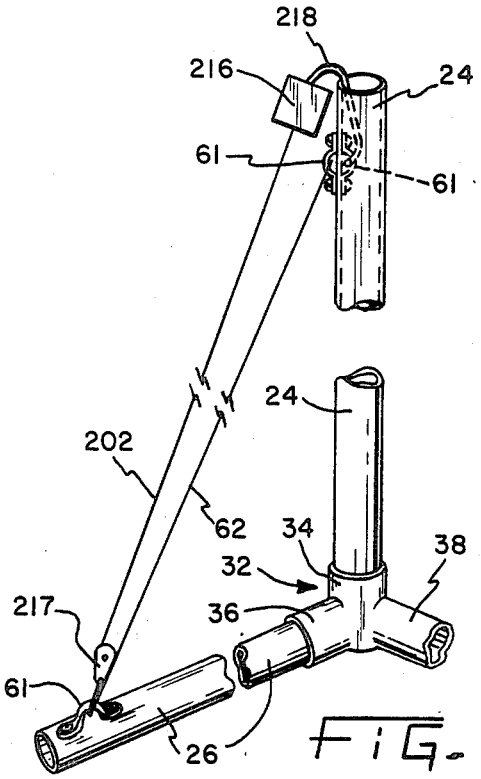
FIG. 16 is a fragmentary detailed perspective view of a mounted furling device.

FIG. 16 illustrates the attachment of furling drum 216 which requires a semi-circular eye 61, a swivel unit 217, and an attachment member 218. A semi-circular eye 61, is secured to the inside surface, directly opposite the semi-circular eye 61, on the outside surface of the distal end portion of vertical spar member 24. The outer semi-circular eye 61 receives one of secondary stays 62. An attachment member 218 such as a Dacron cord sleeved with a hose or a plastic coated galvanized chain is tied or shackled to the inside semi-circular eye 61 and leads out of the distal end of vertical spar member 24 to connect to furling drum 216. A swivel unit 217 is mounted on cable 202 to control sail 214. This arrangement places furling drum 216 in a position above bow spar member 26 and permits furling drum 216 to operate freely, unimpeded by secondary stay 62.

Figure 15:
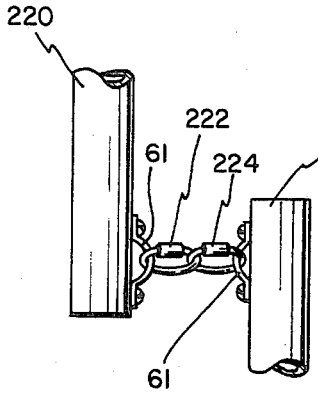
FIG. 15 is a fragmentary detailed isometric view of the attachment of an extension mast to a main mast.

FIGS. 10 and 15 illustrate the connection of an extension mast 220 to the distal end portion of vertical spar member 24 by a pair of pulley clips 222, 224. Pulley clip 222 is attached to the proximal end portion of extension mast 220 and pulley clip 224 is attached to the distal end portion of vertical spar member 24. Pulley clips 222 and 224 link together to hold extension mast 220 in position above vertical spar member 24. Extension mast 220 can have any desired length to provide support for an additional larger sail such as a Genoa sail or the like (not shown). One end of each of three support cables 226 connects to the distal end portion of extension mast 220 and an opposite end of each of the three support cable 226 connects to a distal end portion of one of each of spar members 26, 28, 30.

FIG. 10 also illustrates a stay spreader assembly generally designated as 280. Stay spreader assembly 280 includes three tubes 282 each having opposite ends 284 and 286. Tubes 282 are connected together at their one end 284 to the mast extension near the bottom end of the mast extension. The tubes may be connected together and to the mast extension in a fashion similar to the way in which the mast extension is connected to the mast. Each tube 282 is connected at its other end 286 to its respective cable 226. A stay 288 extends between the other ends 286 of each adjacent pair of tubes. The stay spreader assembly prevents cables 226 and the mast extension from buckling under stress.

In either of the specific embodiments illustrated in FIGS. 1 and 10, the manner of supporting occupants and cargo on watercraft 20 is similar to that of applicant's craft in application Ser. No. 446,595 filed Dec. 3, 1982. Trampoline 228 made of canvas or other suitable lightweight, flexible material and having substantially the shape of an equilateral triangle is connected to the distal end portions of spar members 26, 28, 30. Three rigid tubes 230 are received in respective sleeves 232, (FIGS. 1 and 10), attached to the underside of trampoline 228. Each sleeve 232 is disposed beneath trampoline 228 so that each end of a sleeve 232 terminates at a point on a respective edge of trampoline 228 about $\frac{1}{3}$ the length of the respective edge from a distal end of the respective spars 26, 28, 30. Tubes 230 are received in respective sleeves 232 with their ends extending outwardly beyond trampoline 228 a predetermined distance. Sleeves 232 may be made of the same material as trampoline 228 and may be sewn or otherwise secured to trampoline 228, and tubes 230 may be made of the same material as spar members 24, 26, 28, 30.

As illustrated in FIGS. 1 and 10, a plurality of stays generally designated as 234, are connected between the extended ends of tubes 230 that project outwardly beyond trampoline 228 at a point approximately midway on vertical spar member 24. The connections of the ends of stays 234 to vertical spar member 24 may be the same as the connections between stays 58 and the distal ends of respective spar members 26, 28, 30 to include tensioners 63 such as turnbuckles for tensioning purposes. The opposite ends of stays 234 are secured around respective ends of tubes 230 in a suitably nautical manner.

Another plurality of stays generally designated as 236, are illustrated in FIG. 10. Stays 236 connect the extended ends of tubes 230 to the distal end of the nearest one of spar members 26, 28, 30. The connection between ends of stays 236 and the distal end of the nearest one of spar members 26, 28, 30 may be similar to connections between stays 58 and the distal ends of respective spar members 26, 28, 30 to include tensioners 63 such as turnbuckles for tensioning purposes. As with stays 234, the opposite ends of stays 236 are secured around respective ends of tubes 230 in a suitably nautical manner.

Adjusting tensioners 63 of stays 234, 236 permits the operator to vary the tension or rigidity of trampoline 228 to compensate for added weight on trampoline 228. For example, should extra cargo or passengers be placed on trampoline 228 thereby causing it to be lowered nearer to the water surface, tightening stays 234, 236 by turning respective tensioners 63 will elevate trampoline 228 to a desired height above the water surface. Reversing the above procedure will compensate for reducing the load or weight on trampoline 228.

Figure 20:
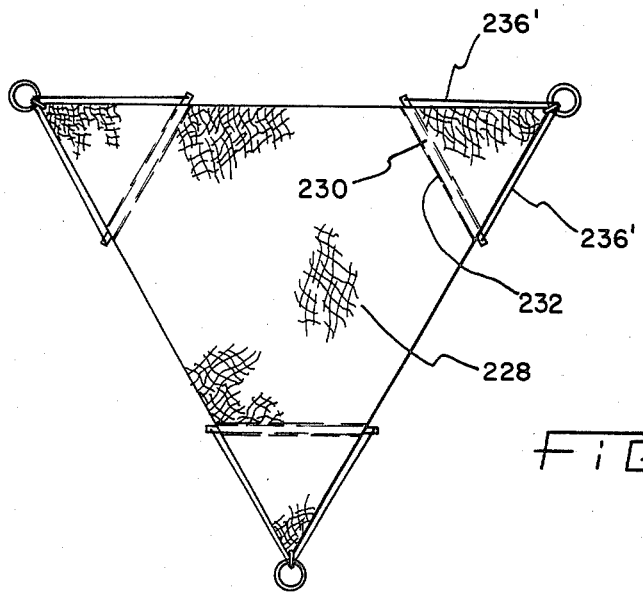
FIG. 20 is a schematic view of an alternate embodiment of an assembly to connect the trampoline to the spars.

An alternate embodiment of the assembly to connect the trampoline to the spar members 26, 28, 30 is illustrated in FIG. 20. The trampoline 228 illustrated in FIG. 20 is of the same construction as that shown in FIG. 10. Tubes 230 are contained in sleeves, and extend from the opposite ends thereof. A stay 236' is connected to each opposite end of the tubes and extends back towards its respective spar member much like the stays 236 show in FIG. 10. However, in FIG. 20, each stay 236' extend so as to be adjacent to its corresponding edge of the trampoline so as to be connected to its corresponding spar at the same point the trampoline is connected to the spar. The trampoline and the stays 236' can share common linkage assemblies to connect them to the spar members.

Assistance in properly rigging watercraft 20 and for other general requirements in sailing watercraft 20 is provided by staggered steps 238, (FIGS. 1, 10), mounted on vertical spar member 24. Staggered steps 238 are mounted such that the plane containing the port steps and the plane containing the starboard steps are angled backwardly toward the stern spar member 30. This substantially prevents any possibility of sail 214 becoming entangled with steps 238 during the sailing of watercraft 20 or during the intentional disassembling of watercraft 20.

Figure 21:
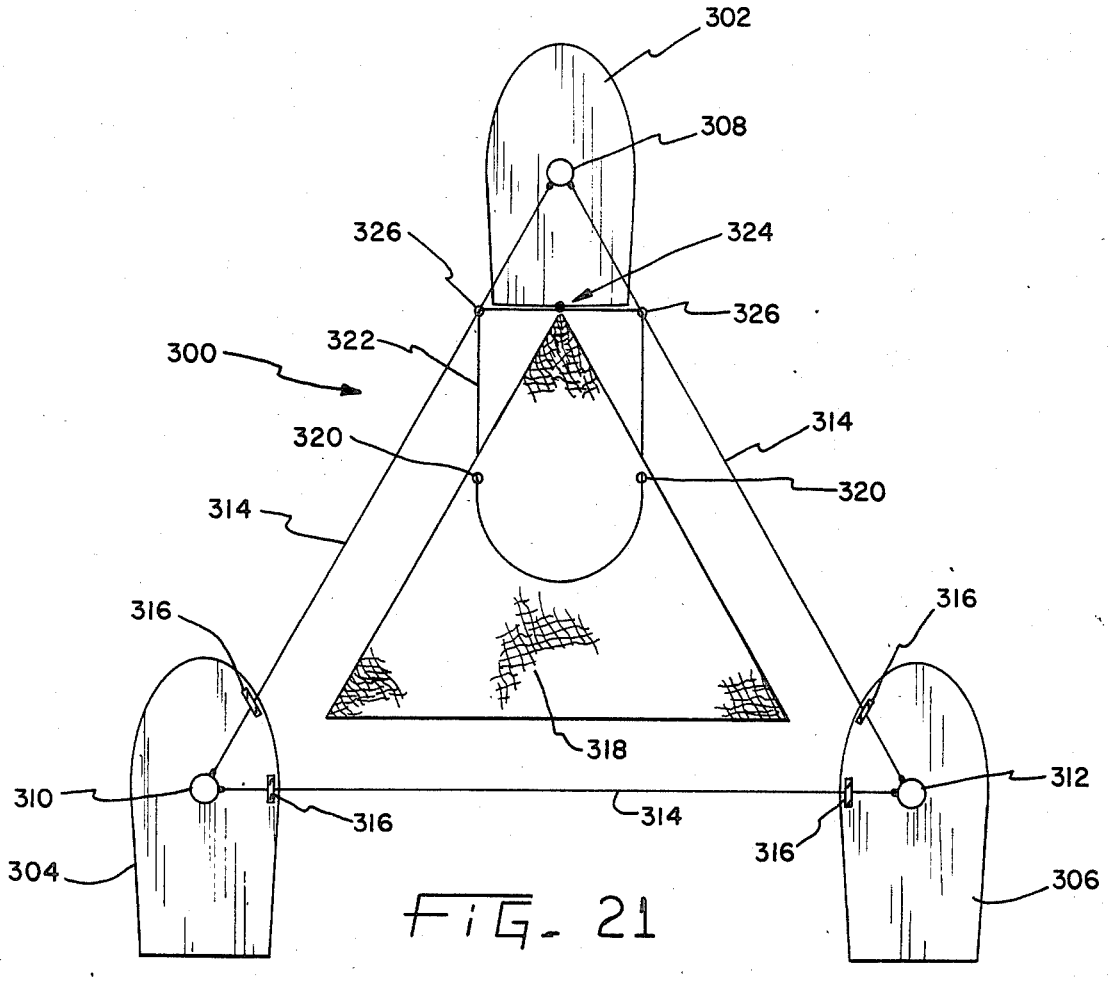
FIG. 21 is a schematic view of an alternate specific embodiment of the invention wherein the watercraft is steered at the lead pontoon.

FIG. 21 illustrates a mechanical schematic of the lower portion of a watercraft 300 that is an alternate specific embodiment of the watercraft 20 illustrated by FIG. 1. Watercraft 300 includes three equi-spaced pontoons 302, 304 and 306 positioned so as to constitute the vertices of an equilateral triangle. The pontoons are positioned so that there is a lead pontoon 302 and two trailing pontoons 304 and 306. The lead pontoon contains a motor. A spar member 308, 310 and 312 is mounted to each pontoon 302, 304, 306, respectively, in a fashion that is similar to that shown in FIG. 1. A stay 314 extends between the bottom end of each adjacent pair of spar members. A pair of primary tether assemblies 316 are mounted to each of the trailing pontoons. Each tether assembly 316 is constructed so as to be identical to each earlier-described tether assembly 168. Tether assemblies 316 hold the stays 314 as illustrated.

A trampoline 318 of a substantially identical construction as the trampoline of FIG. 1 is illustrated in FIG. 21. Trampoline 318 contains a pair of grommet holes 320 therein. A steering rein 322 is attached to the stern of the lead pontoon 302 at point 324. Each of the two stays 314 that extend from the lead pontoon has a ring or fairlead 326 forwardly positioned thereon. Steering rein 322 passes through each ring 326, and also passes through each grommet hole 320 in the trampoline. The grommet noles serve to prevent chaffing of the trampoline. The remaining structure of watercraft 300, although not illustrated, is substantially similar to the corresponding structure of the watercraft illustrated in FIG. 1.

As can be appreciated, the watercraft is steered by turning the lead pontoon oy means of the steering reins. One can pull on the right-hand portion of the steering reins and cause the lead pontoon to turn to the left. One can pull on the left-hand pontoon of the steering reins and cause the lead pontoon to turn to the right. It can thus be appreciated that applicant has provided a relatively structurally simple and yet efficient assembly for steering the watercraft.

While this invention has been described as having a preferred embodiment it will be understood that it is capable of further modification. This application is, therefore, intended to cover any variations, uses, or adaptations of the invention following the general principles thereof, and including such departures from the present disclosure as come within known or customary practice in the art to which this invention pertains and falls within the limits of the appended claims.

What is claimed is:

1. In a watercraft, the combination comprising:

a plurality of spaced-apart flotation members;

a plurality of elongate spar members having opposite proximal and distal ends, each of said elongate spar members corresponding to one of said flotation members;

a generally vertical spar member having opposite proximal and distal ends;

a juncture means for receiving the proximal ends of each of said elongate spar members and said vertical spar member; and a plurality of spar attachment means each for connecting the distal end of one of said elongate spar members to its corresponding flotation member, each of said spar attachment means including an elongate mounting bracket attached to the distal end of its corresponding elongate spar member, said mounting bracket having a connection portion defining an aperture therein, and a mounting assembly attached to its corresponding flotation member, said mounting assembly having an upstanding fastener which extends through said aperture and a coupling member received about said upstanding fastener having a lower reduced diameter portion extending through said aperture between said fastener and said connection portion of said mounting bracket in spaced relation thereto so as to connect said corresponding spar member to its corresponding flotation member and permit said corresponding spar member to move omni-directionally relative thereto, said coupling member having an upper enlarged diameter portion which overlies said connection portion of said mounting bracket and has a diameter greater than the diameter of said aperture so as to limit the omni-directional movement of said corresponding spar member relative to its corresponding flotation member.

2. The watercraft of claim 1 wherein said elongate mounting bracket has opposite ends, said mounting bracket including a mounting portion adjacent one end thereof at which said bracket is attached to the distal end of its corresponding said spar member, said connection portion being disposed adjacent the other end of said elongate mounting bracket, said mounting portion and connection portion being disposed relative to one another at an obtuse angle.

3. The watercraft of claim 1 wherein said coupling member is an annular bushing.

4. The watercraft of claim 2 wherein said mounting portion of each bracket is configured so as to be complementary to its corresponding said spar member.

5. The watercraft of claim 1 wherein said enlarged diameter portion of said coupling member includes an annular washer and said reduced diameter portion of said coupling member includes an annular bushing.

6. The watercraft of claim 5 wherein:

said upstanding fastener of said mounting assembly extends between a top and bottom surface of its corresponding flotation member; and said mounting assembly further includes a lower support plate being received by said upstanding fastener so as to be adjacent the bottom surface of the flotation member, a nut threadedly received on said upstanding fastener so as to sandwich said lower support plate between said nut and the bottom surface of the flotation member, an upper support plate being received by said upstanding fastener so as to be adjacent the top surface of the flotation member, said annular bushing being received by said upstanding fastener resting on said upper support plate, said annular washer received by said upstanding fastener resting on top of said bushing, and a nut threadedly received by said upstanding fastener so as to sandwich said washer and bushing between said nut and upper support plate.

7. In a watercraft, the combination comprising:

a plurality of spaced-apart flotation members;

a plurality of elongate spar members having opposite proximal and distal ends, each of said elongate spar members corresponding to one of said flotation members and connected thereto at its distal end;

a generally vertical spar member having opposite proximal and distal ends;

a juncture means for receiving a proximal end of each of said elongate spar members and said vertical spar member;

a stabilization means for flexibly stabilizing the plurality of spaced-apart flotation members; and a derrick assembly movably attached to said juncture means and coupled to said distal end of said vertical spar member so as to have a 120° working angle.

8. The watercraft of claim 7 wherein said derrick assembly includes a derrick, means for connecting the derrick to the juncture means, a lifting means for lifting objects, a vertical adjustment means coupled to the distal end of said vertical spar member for selectively adjusting the vertical position of the derrick, and a lateral adjustment means coupled to the distal ends of at least two of said elongate spar members for selectively adjusting the lateral position of the derrick.

* * * * *